US005490369A

United States Patent [19]

Ellis et al.

[11] Patent Number: 5,490,369

[45] Date of Patent: Feb. 13, 1996

[54] CAPPING HEAD WITH MAGNETIC CLUTCH

[75] Inventors: Darwin L. Ellis, Richmond, Ind.; James D. Duke, New Paris, Ohio; David A. Willis, Economy, Ind.

[73] Assignee: Aluminum Company of America, Pittsburgh, Pa.

[21] Appl. No.: 327,566

[22] Filed: Oct. 24, 1994

[51] Int. Cl.[6] ..... B67B 3/20; B65B 7/28

[52] U.S. Cl. ..... 53/317; 53/331.5

[58] Field of Search ..... 53/317, 331.5, 53/334, 306, 307, 308

[56] References Cited

U.S. PATENT DOCUMENTS

| | | | |
|---|---|---|---|
| 4,485,609 | 12/1984 | Kowal | 53/331.5 |
| 4,492,068 | 1/1985 | Obrist | 53/331.5 |
| 4,633,646 | 1/1987 | Ellis et al. | 53/317 X |
| 4,674,264 | 6/1987 | Ellis et al. | 53/331.5 |
| 5,157,897 | 10/1992 | McKee et al. | 53/308 |
| 5,197,258 | 3/1993 | Johanek | 53/317 |
| 5,284,001 | 2/1994 | Ochs | 53/331.5 X |
| 5,313,765 | 5/1994 | Martin | 53/317 |

*Primary Examiner*—Horace M. Culver

*Attorney, Agent, or Firm*—Dressler, Goldsmith, Shore & Milnamow, Ltd.

[57] ABSTRACT

A capping head including a housing assembly including a magnetic clutch interconnecting a drive spindle and a quill for applying a closure to a container. The magnetic clutch consists of opposed rings of magnets and one of the rings is disposed in a piston ring assembly that is quickly and easily adjustable relative to the other to vary the torque limit of the clutch. A simple yet efficient clamping assembly is employed to facilitate ready adjustment and retention of the movable piston ring.

9 Claims, 2 Drawing Sheets

CAPPING HEAD WITH MAGNETIC CLUTCH

FIELD OF THE INVENTION

This invention relates to a screw capping head with a magnetic clutch for applying prethreaded closures onto threaded containers.

BACKGROUND OF THE INVENTION

Capping machines for the application of prethreaded closures onto prethreaded containers have been known for some time. In order to insure that a prethreaded closure is not applied too tightly, which could possibly result in damage, conventional screw capping machines are provided with a screw capping head having a torque dependent clutch. The clutch limits the maximum torque which can be transmitted to the prethreaded closure and clutches of various types have been used. These have included slipping clutches and mechanical torque limiting clutches and also magnetic clutches such as those disclosed in U.S. Pat. Nos. 4,364,218, 4,492,068, 4,674,264, and 5,197,258. While these various types of magnetic clutches have been generally satisfactory, they do not adapt themselves to ready adjustability, thus resulting in substantial down time when changes in the amount of applied torque are required due to different closures being applied, application forces required, etc.

Briefly, the present invention relates to a screw capping head assembly for applying prethreaded closures onto prethreaded containers which provides for readily changing the torque to be applied to the various closures, thus making the capping head adaptable to be used with a variety of different closures and containers. A capping head incorporating the instant invention includes a first housing assembly adapted to be secured to a rotatable drive spindle and a quill mounted in an adjacent housing assembly interconnected but permitting free rotation with respect to the first housing assembly. A chuck is coaxially secured to the quill and has a tapered internal surface for gripping a prethreaded closure during the capping operation. The capping head includes a magnetic clutch comprising a first circular ring of magnets secured to the housing portion of the capping head to which a drive spindle is connected and a second coaxial spaced ring of magnets secured to the housing assembly to which the quill is connected. The gap between these axially spaced sets of magnets determines the torque to be applied to the closure. The clutch is capable of slipping after the application of a prethreaded closure onto a prethreaded container when the desired torque value has been reached. Essentially, the mode of operation is that as the chuck engages the cap upon the container to be capped, a top load is provided for cap-to-container sealing and/or for adequate rotary frictional engagement between the chuck and the cap, by slight telescoping of the spindle and housing to compress a spring disposed therebetween.

From the above description, it will be seen that the magnetic attraction between the magnetic rings will impart a torque load from the housing which rotates with the drive spindle to the chuck assembly. This torque load permits the chuck assembly to engage and tighten a cap which has previously been threadably engaged with a container to a predeterminable tightness beyond which the mechanical resistance to further tightening overcomes the magnetic attraction. When this occurs, the magnetic clutch merely slips as the spindle and associated housing continue to rotate with respect to the quill assembly.

SUMMARY OF THE INVENTION

The novel capping head assembly forming the present invention provides for a ready adjustment of the maximum torque to be applied by utilizing a movable torque ring piston type assembly that incorporates a set of magnets. The position of the piston assembly is readily adjustable to vary the gap and thus the magnetic force between the spaced rings of magnets. The novel capping head assembly also includes a clamping mechanism that can be readily engaged and released to facilitate ready adjustment and locking in place of the piston assembly.

To further increase the durability and efficiency of the capping head, the connection between the drive spindle and the housing assembly containing the piston assembly consists of a plurality of dowel pins that permit ready longitudinal movement between the drive spindle and the housing yet maintains a positive driving action during rotation and vertical movement of the capping head during the capping operation. The pins are a substantial improvement over heretofore-used mechanisms, such as splines or locking keys in which the wearing conditions were such as to require replacement more often or make the original cost of the capping head more expensive.

In accordance with the present invention, the novel mechanism for quickly and easily varying the spacing between the opposing magnets of the magnetic clutch consists of providing a first set of magnets in a piston ring assembly that is slidably disposed within the capping head housing. The piston contains a number of spirally arranged holes that are exposed to a spiral shaped slot formed in the adjacent housing. The piston is free to be vertically moved within the housing by a pin or the like that extends into one of said holes through the spiral slot, which pin is moved through the spiral slot to vertically raise or lower the piston to change the air gap and thus the torque limit between the adjacent rings of magnets. When the piston ring is positioned to obtain the desired torque level, a simple but effective clamping mechanism is activated to secure the piston ring in position and thus lock in the desired torque. To change the torque setting, the clamp is loosened, the piston ring moved upwardly or downwardly by moving the loosely disposed pin in the piston assembly in the spiral opening in the housing and then reclamping the piston ring to the housing when the desired setting has been reached.

Other objects and advantages of the present invention will become more apparent to those skilled in the art in view of the following description and the accompanying drawings.

DETAILED DESCRIPTION OF THE PREFERRED EMBODIMENT

Figure 1:
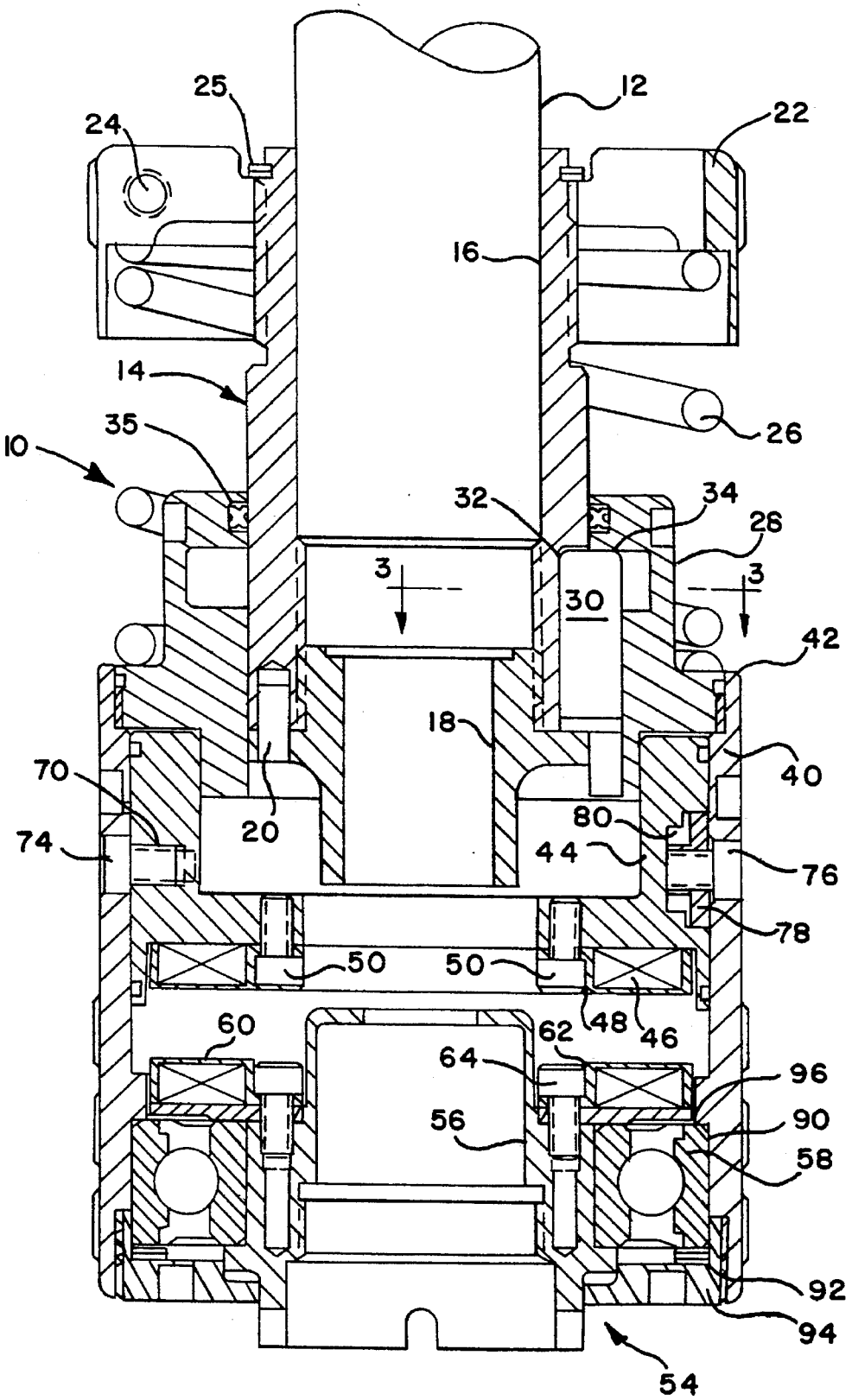
FIG. 1 is a cross-sectional view of a capping head embodying the present invention.
Figure 3:
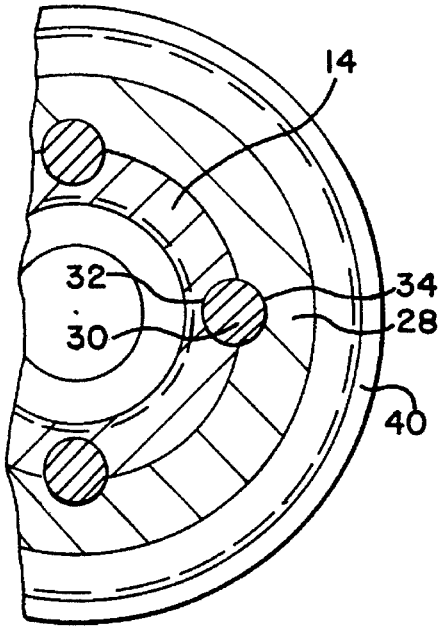
FIG. 3 is a view taken along line 3—3 of FIG. 1 illustrating the pin connection between the top load drive assembly and torque ring housing assembly.

Referring to FIG. 1, a screw capping head assembly 10 is shown attached to a rotatable drive spindle 12. It is common for a screw capping machine to utilize a turret assembly having eight, ten, or more such screw capping heads positioned in a circular fashion about a turret which reciprocate up and down so as to move into alignment with a container that is to be sealed with a prethreaded closure. The screw capping head 10 incorporates a mounting hub assembly 14 consisting of an upper tubular portion 16 and a lower section 18 that is threaded into the lower portion of tube 16 and held in place by pins 20. The mounting hub portion 16 has threaded to its upper end a split collar 22 which is clamped thereto by a screw 24 and positioned relative to hub portion 16 by special retaining ring 25. The split collar 22 provides a stop for a compression spring 26 which acts at its lower end against the upper housing 28 of the capping head to resiliently bias the housing 28 in a downwardly direction. The hub portion 16 is connected to the upper housing 28 by four circumferentially spaced dowel pins 30 that are located in adjacent semi-cylindrical recesses 32, 34 formed in the hub portion 16 and upper housing 28, respectively, as shown more specifically in FIG. 3.

The torque from the drive shaft 12 is transmitted to the upper housing 28 through the pins 30. The aforementioned connection permits the housing 28 to move relative to the mounting hub assembly against the action of the spring 26 during which action the pins will move in the cooperating recesses 32, 34. These pins which provide a positive connection between the hub and housing are inexpensive and can be readily changed should extensive wear occur. Ring 35 is provided between hub member 16 and housing 28.

The intermediate housing member 40 is threaded onto the upper housing 28 by threads 42. The housing 40 is hollow and includes therein a torque ring magnet assembly 44 in the form of an adjustable piston member that is slidably disposed with respect to the inner wall of the housing 40. Located in the lower end of torque ring 44 are a plurality of magnets 46 which in the instant case consist of twelve, but this number is merely exemplary. The magnets are disposed in a ring member 48 that is secured to the torque ring 44 by fasteners 50.

The lower housing assembly 54 which includes the quill 56 is freely movable relative to the intermediate housing 40 by means of a roller bearing assemblage 58 interconnecting the quill 56 and housing 40. As part of the quill assembly, there are provided a plurality of magnets 60 that are disposed in a magnet carrier assembly 62 that is secured to the quill assembly by fasteners 64. The carrier member 62 is vertically spaced from the ring member 48 with the magnets 46 and 60 being axially aligned. The adjacent rings of magnets define the magnetic clutch and thus, as is well known by those skilled in the art, the transmittable torque between the housing 40 and the quill assembly 54 is determined by the gap between the magnets 46 and 60. Thus, when the magnets are closer together, there is a greater torque transmitted between the housing 40 and quill assembly 54, and conversely, when the magnets 46,60 are spaced further apart, the torque limit is reduced. Generally speaking, the gap between the magnet rings will vary between 0.34 mm to 9 mm, which will provide a torque limit variation between 30 and 3 inch pounds, respectively.

In view of the above, it can be seen that the adjustable position of the torque ring assembly 44 determines the torque to be transmitted between the housing 40 and the quill assembly 54.

Figure 2:
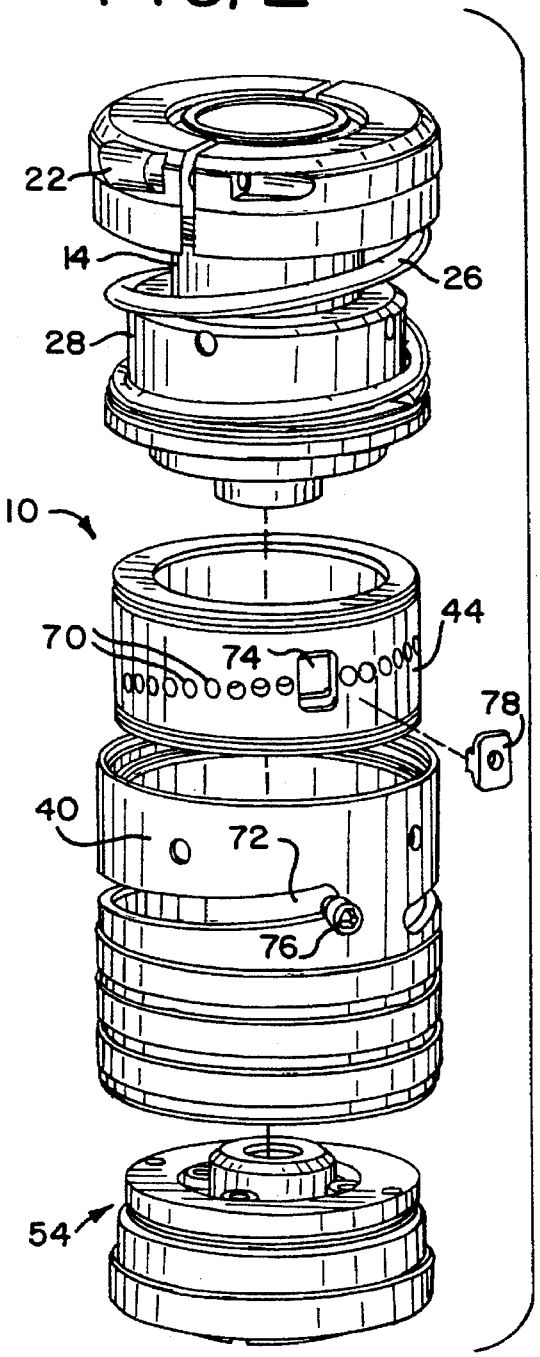
FIG. 2 is an exploded view showing the top load and drive assembly, the torque ring piston and lower housing assembly, and the lower magnet bearing quill assembly.

To facilitate vertical adjustment of the torque ring assembly 44, there are provided a plurality of openings 70 in the torque ring which correlate with a spiral slot 72 formed in the outer housing 40 (see FIG. 2). Pins 74 may be provided (see FIG. 1) that are inserted in the requisite opening and positioned in the slot. The position of particular pins can be calibrated and marked on the outer wall of the housing 40 to indicate the torque setting when the pin reaches a certain position in the slot (not shown).

Specifically, by the utilization of spaced pins in preselected openings, various torques can be selected by rotation of the piston to where the pins engage the end of the slot, or are located adjacent appropriate marking on the housing, or positioned as determined by a torque meter. During normal production runs, by adjusting the piston to where a particular pin engages a selected end of the slot, preset torques can be set for two different caps in a quick and efficient manner.

The movement of the torque ring assembly can be accomplished by the movement of a member such as a screw 76 connected to the ring which when moved in the slot raises or lowers the torque ring and thus the spacing between the magnets 46 relative to the magnets 60 in the quill assembly. The repositioning of the ring assembly 44 changes the torque to be transmitted between the torque ring and the quill assembly before slippage occurs. This screw 76 performs a double function in that it also serves in cooperation with a block 78 to clamp the torque ring 44 relative to the housing 40 so that after the torque setting has been made the torque ring 44 will remain fixed in position.

As shown in FIG. 1, the screw 76 fits into a recess 80 in the torque ring 44. The screw 76 is threaded through an opening in the block 78 against the base of the recess 80. Rotation of the screw 76 against the base of the recess in one direction moves the clamping block 78 away from the inner wall of the housing 40 to permit the torque ring 44 to be readily moved in a vertical direction by moving the ring 44 vertically, resulting from movement of the pin 76 in the slot 72. After the torque ring 44 has been positioned, the screw 76 is turned in the other direction to clamp the block 78 against the inner wall of the housing 40 to lock the torque ring in place. The pins 74 that may be used to define various settings of the torque ring are shown in FIG. 1 and as noted are recessed within the outer wall of the housing 40 and thus are not exposed to wear.

Returning to the quill assembly 54 located in the bottom portion of capping head assembly 10, it is noted that at the bottom of the housing 40, there is provided a recess 90 in which the outer race of bearing 58 is located. This bearing is held in place by a retaining ring 92 that is positioned against the outer bearing race by a bearing retainer 94. The outer race of the bearing is biased up against a flange 96 of the lower housing 40 and its inner race is secured in place relative to quill 56 by being located between the magnet carrier member 62 on which the lower ring of magnets 60 are located. As aforementioned, the carrier member 62 is secured to the quill assembly 54 by fasteners 64.

Thus, it can be seen that the housing 40 when driven by the drive shaft 12 through the hub member 14, and upper housing 28 will drive the quill assembly 54 through the magnetic clutch assembly, but when the torque limit is reached, the drive shaft hub and housing containing the torque ring will freely move relative to the quill assembly.

It is intended to cover by the appended claims all modifications which come within the true spirit and scope of the invention.

What is claimed is:

1. A capping head assembly comprising a first housing assembly secured to a rotatable drive member, a second housing assembly including a quill mounted in said second housing assembly for free rotation relative to said first housing assembly, a magnetic clutch comprising a first ring of magnets in a torque ring that is slidably movable relative to said first housing assembly and a second ring of magnets in said second housing assembly axially spaced from said first ring of magnets, means for adjusting the position of said torque ring relative to said first housing assembly comprising a spiral slot in said first housing assembly, openings in said torque ring exposed through said slot and means extending through said slot into an opening to move said torque ring to the requisite position whereby the space between said magnets can be changed to vary the torque limit of said magnetic clutch and means for affixing said torque ring relative to said first housing assembly to retain said torque ring in a fixed position.

2. A capping head assembly in accordance with claim 1 in which the first housing assembly includes an upper section and a mounting hub slidably disposed within said upper section which mounting hub is adapted to receive a rotatable drive spindle, said mounting hub and upper housing section defining cooperating semi-cylindrical recesses and cylindrical pin means disposed in said housing to interconnect the mounting hub and upper housing section but permitting slidable movement between said mounting hub and upper housing section.

3. A capping assembly in accordance with claim 1 including clamping means extending through an opening defined by said first housing assembly into a recess defined by said torque ring including a clamping member located adjacent said first housing assembly and screw means connected to said clamping member and engaging said torque ring for screwing said clamping member against said first housing assembly for locking said torque ring in position.

4. A capping assembly in accordance with claim 1 in which the mounting hub includes an upper portion which receives the rotatable drive spindle and a lower portion that is threadably adjusted relative to said upper portion and includes an annular flange to retain said pins in position relative to said mounting hub and fastening means for locking said lower portion relative to said upper portion.

5. A capping head assembly comprising a first housing assembly secured to a rotatable drive member including an upper section and a mounting hub slidably disposed within said upper section which mounting hub is adapted to receive a rotatable drive spindle, said mounting hub and upper housing section defining cooperating semi-cylindrical recesses and cylindrical pin means disposed in said recesses to interconnect the mounting hub and upper housing section but permitting slidable movement between said mounting hub and upper housing section, a second housing assembly including a quill mounted in said second housing assembly for free rotation relative to said first housing assembly, a magnetic clutch comprising a first ring of magnets in a torque ring that is slidably movable relative to said first housing assembly and a second ring of magnets in said second housing assembly axially spaced from said first ring of magnets, means for adjusting the position of said torque ring relative to said first housing assembly whereby the space between said magnets can be changed to vary the torque limit of said magnetic clutch and means for affixing said torque ring relative to said first housing assembly to retain said torque ring in a fixed position.

6. A capping assembly in accordance with claim 5 in which the mounting hub includes an upper portion which receives the rotatable drive spindle and a lower portion that is threadably adjusted relative to said upper portion and includes an annular flange to retain said pins in position relative to said mounting hub and fastening means for locking said lower portion relative to said upper portion.

7. A capping assembly in accordance with claim 6 including clamping means extending through an opening defined by said first housing assembly into a recess defined by said torque ring including a clamping member located adjacent said first housing assembly and screw means connected to said clamping member and engaging said torque ring for screwing said clamping member against said first housing assembly for locking said torque ring in position.

8. A capping assembly in accordance with claim 5 including clamping means extending through an opening defined by said first housing assembly into a recess defined by said torque ring including a clamping member located adjacent said first housing assembly and screw means connected to said clamping member and engaging said torque ring for screwing said clamping member against said first housing assembly for locking said torque ring in position.

9. A capping head assembly comprising a first housing assembly secured to a rotatable drive member, a second housing assembly including a quill mounted in said second housing assembly for free rotation relative to said first housing assembly, a magnetic clutch comprising a first ring of magnets in a torque ring that is slidably movable relative to said first housing assembly and a second ring of magnets in said second housing assembly axially spaced from said first ring of magnets, means for adjusting the position of said torque ring relative to said first housing assembly whereby the space between said magnets can be changed to vary the torque limit of said magnetic clutch and clamping means extending through an opening defined by said first housing assembly into a recess defined by said torque ring including a clamping member located adjacent said first housing assembly and screw means connected to said clamping member and engaging said torque ring for screwing said clamping member against said first housing assembly for locking said torque ring in position.

* * * * *